United States Patent [19]

Niskanen et al.

[11] Patent Number: 5,034,120

[45] Date of Patent: Jul. 23, 1991

[54] METHOD FOR KEEPING A SCREEN OR FILTER SURFACE CLEAR

[75] Inventors: Toivo Niskanen, Hamina; Vesa J. Vikman, Kymi, both of Finland

[73] Assignee: A. Ahlstrom Corporation, Noormarkku, Finland

[21] Appl. No.: 463,934

[22] Filed: Jan. 8, 1990

Related U.S. Application Data

[63] Continuation-in-part of Ser. No. 215,578, Jul. 6, 1988, abandoned.

[30] Foreign Application Priority Data

Jul. 6, 1987 [FI] Finland ..... 872969

[51] Int. Cl.[5] ..... B07B 1/50; B01D 33/44; B01D 29/62

[52] U.S. Cl. ..... 209/270; 209/273; 209/380; 210/394; 210/408; 210/798

[58] Field of Search ..... 209/268, 270, 273, 379, 209/380; 210/394, 408, 410–413, 798

[56] References Cited

U.S. PATENT DOCUMENTS

| | | | |
|---|---|---|---|
| 2,835,173 | 5/1958 | Martindale . | |
| 3,311,235 | 3/1967 | Ahlfors et al. | 209/270 |
| 3,446,354 | 5/1969 | Skardal | 209/380 X |
| 3,477,571 | 11/1969 | Maag | 209/304 X |
| 3,581,093 | 6/1971 | Rich | 209/273 |
| 3,845,863 | 11/1974 | Savia | 209/303 |
| 3,898,157 | 8/1975 | Hooper | 209/306 |
| 4,042,503 | 8/1977 | Justus | 209/273 X |
| 4,684,444 | 8/1987 | Meinecke et al. | 210/349 X |
| 4,710,287 | 12/1987 | Henrich et al. | 209/270 |

FOREIGN PATENT DOCUMENTS

| | | | |
|---|---|---|---|
| 0042498 | 8/1970 | Finland . | |
| 0056216 | 10/1981 | Finland . | |
| 2384528 | 10/1978 | France . | |
| 61-200826 | 9/1986 | Japan | 210/407 |

*Primary Examiner*—Michael S. Huppert
*Assistant Examiner*—Edward M. Wacyra
*Attorney, Agent, or Firm*—Toren, McGeady & Associates

[57] ABSTRACT

A method for keeping a screen surface or a filter surface clean, wherein a pressure fluid is introduced from a conduit to a secondary side of a screen/filter drum, which fluid flows, during an underpressurized stage caused by blades of a rotor rotating on a primary side of the screen/filter drum, through the screen/filter drum from the secondary side to the primary side thereby rinsing the openings of the drum and making them clear.

4 Claims, 2 Drawing Sheets

METHOD FOR KEEPING A SCREEN OR FILTER SURFACE CLEAR

Figure 1:
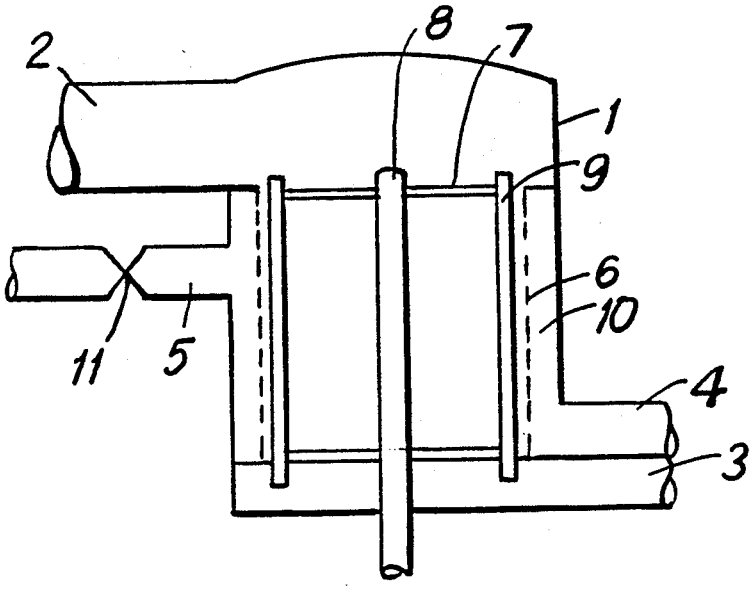

This is a continuation-in-part application of Ser. No. 07/215,578, filed July 6, 1988, now abandoned.

The present invention relates to a method for keeping a screen surface or filter surface clear. It is especially suitable for the perforated surfaces of the equipment treating fiber suspensions in the pulp and paper industry, which surfaces are inclined to become clogged every now and then because of fibers penetrating the openings of the screen surface and adhering to them.

Fiber material, especially cellulose and wood fiber pulp, is treated in the form of fiber suspension where the fibers are, depending on the consistency of the suspension, more or less loose. Such pulps are treated by, for example, pumps, thickeners and various types of screens and filters. Part of such means is intended for separation of air from the fiber suspension, another part for separation of liquid from the fiber suspension, still another part for screening the fiber suspension into various fractions and a further part merely for conveying the fiber suspension. All means performing said functions are provided with perforated surfaces, in other words, surfaces with holes or slots where the fibers are prone to penetrate, thus clogging the perforations.

In previously known means, the screen/filter surface has mostly been kept clear by a rotor, which either mechanically wipes the perforated surface or rotates very close to the surface, thus directing, by means of its front edge, a slight pressure stroke towards the screen/-filter surface and, in the area of its back edge, a slight pressure stroke in the opposite direction creating an underpressure zone, which is intended for loosening the fiber mat formed on the screen/-filter surface, mainly by creating turbulence that breaks the fiber layer, thereby opening the perforations of the surface.

In the long run, the openings however become clogged with fibers, which do not become loose by means of the underpressure caused by a rotor blade but on the contrary, the capacity of the screen/filter surface slowly and continuously lowers or the pressure difference allowed over the screen becomes restricted.

On the other hand, a method of clearing filter surfaces by means of compressed air is known, for example, with disc filters. An underpressure prevails on the bottom sector inside the filter disc, by means of which underpressure the fiber suspension is drawn against the filter surface, whereby liquid becomes filtered through the filter surface into the disc. While the disc is rotating and the fiber cake adhered to said disc is rising up from the pulp vat, a compressed air flow is directed outwards from the inside of the filter disc, which flow forces the pulp cake off of the filter surfaces. This method, even if it were applied to, for example, drum filters or screen drums, is not capable of keeping the screen/filter surfaces as clear as they should be, but the surfaces accumulate a substantial fiber layer instead, which slows down the function of the apparatus and lowers its capacity.

The object of the invention is, therefore, to provide a method for introducing a continuous flow of fiber suspension onto the screen/filter surface, which fiber suspension is, at no stage, allowed to form a fiber mat on said screen/filter surface to hamper the operation thereof, but said fiber suspension is allowed to flow along the surface and towards the outlet opening whilst being treated efficiently all the time. The basis of the apparatus of the example may be a conventional apparatus equipped with a screen drum, in which apparatus, close to the drum surface there rotates a rotor, which may be a conventional blade type member or equivalent.

The invention is based on the fact that in the prior art there are a number of known apparatuses utilizing water for washing the screen or filter surface, but, simultaneously with washing the water dilutes the pulp to be treated. Thus, the consistency of either the accepts or the rejects, or even of both, is unnecessarily decreased. To be able to wash the screen or filter surface such a washing medium has to be used which does not affect the consistency or have some other negative effect on the pulp. Therefore, a gaseous medium is considered proper for said purpose. Of course, in order to be sure that such a medium has no effect on the pulp, an inert gas like nitrogen could be used, but in most cases air can very well be used as pulp always contains more or less air.

Additionally, the treatment equipment used nowadays are often open, i.e., the pulp is almost all the time in connection with the outside atmosphere and therefore some excess air used for washing the screening/filtering openings cannot be considered a harmful feature. It is noted that due to the operation principle of our invention the washing medium does not necessarily have to be gaseous, but only such that its specific gravity is considerably lower than that of the pulp, i.e., that of water and that the medium can be easily separated from the pulp or that said medium by itself is separated from the pulp.

The method in accordance with a preferred embodiment of the invention includes the steps of:

feeding pulp into a pulp treating means at a pressurized state;

making the pulp rotate by rotating a means for creating local pressure fluctuations;

passing a first fraction of the pulp through a perforated surface by means of the combined effect of the feed pressure and a centrifugal force caused by the rotation of the pulp;

creating a low pressure zone between the rotating means for creating local pressure fluctuations and the perforated surfaces;

introducing a medium having a specific gravity lower than that of the pulp to be treated to the side of the perforated surface facing the first fraction;

bringing the medium in communication with the perforated surface;

making the medium flow through the perforated surface due to the fact that the pressure of the medium is higher than the pressure being formed in the low pressure zone, whereby the medium backflushes the perforated surfaces; and collecting the medium into the center of the pulp treating means.

According to a further embodiment, the method includes the steps of:

feeding the pulp into the pulp treating means at a pressurized state;

making the pulp rotate by rotating the perforated surface;

passing a first fraction of the pulp through the perforated surface by means of the combined effect of the feed pressure and a pressure formed of the centrifugal forces caused by rotation of the pulp;

creating a high pressure zone between the rotating perforated surface and means for creating local pressure fluctuations;

introducing a medium having a specific gravity lower than that of the pulp to be treated to the side of the perforated surface facing the first fraction;

bringing the medium in communication with the perforated surface;

making the medium flow through the perforated surface due to the fact that the pressure of the medium in the high pressure zone is higher than the combined effect of the feed pressure and a pressure generated by the centrifugal force, whereby the medium backflushes the perforated surfaces; and collecting the medium in to the center of the pulp treating means.

Advantages gained by the above two methods in accordance with the invention are, for example, such that maintaining the screen surface clear is secured because bigger pressure differences are available in comparison with earlier known means. As a consequence of the screen/filter surface staying clear the pulp treating process is much more efficient than with the equipment of the prior art, thus resulting in a considerably higher pulp treating capacity than before.

Additionally, and at least when compared to apparatuses including perforated surfaces being washed by means of liquid, i.e., water, the consistency is maintained at a higher level by washing with air.

Figure 2:
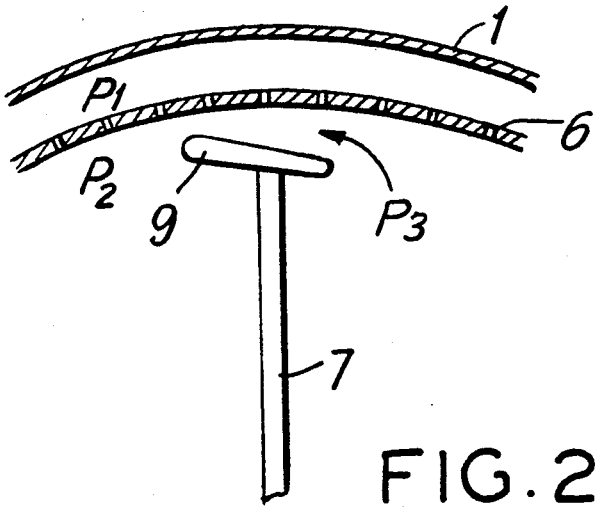
Figure 5:
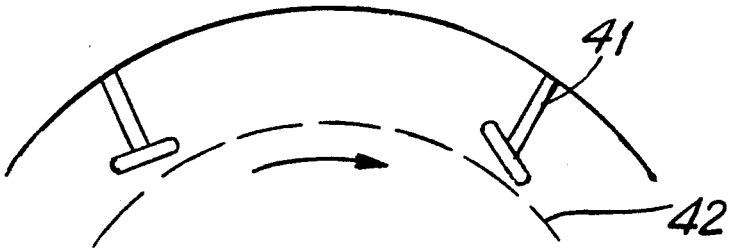
Figure 3:
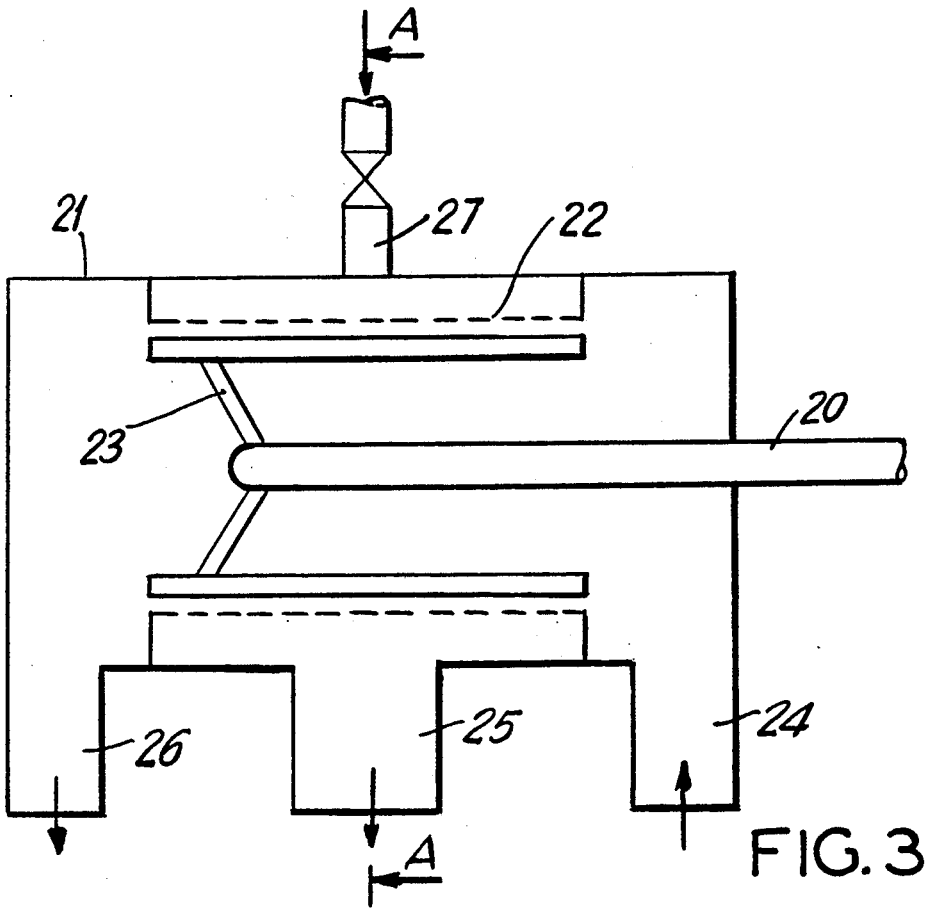
Figure 4:
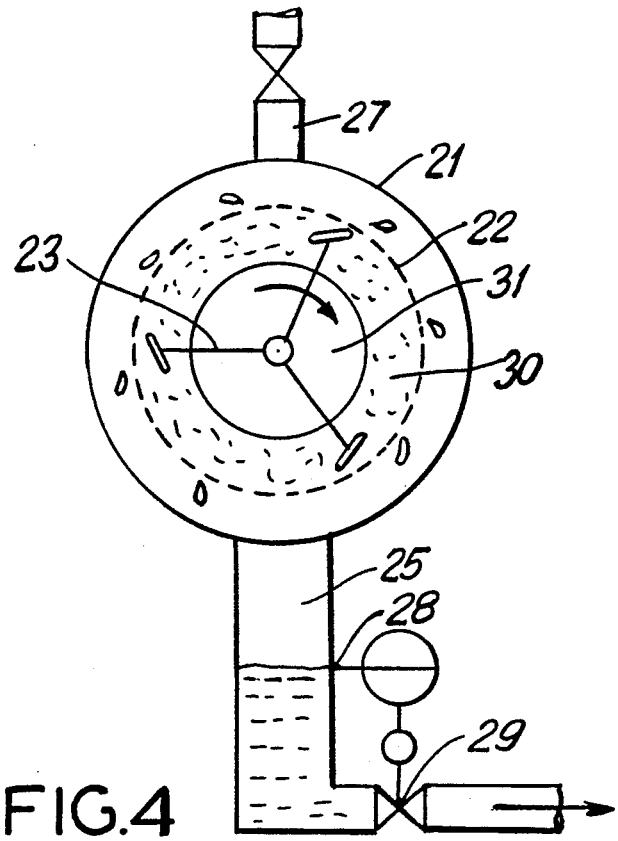

The method in accordance with the invention will be described in greater detail in the following in connection with the pulp treating means putting the method into effect with reference to the accompanying drawings, in which FIG. 1 is an illustration of a conventional pulp treating means modified for the requirements of a first preferred embodiment of the invention, FIG. 2 is a detailed illustration of the function of the pulp treating means in accordance with FIG. 1, FIG. 3 is an illustration of a second preferred embodiment of a modern pulp treating means designed for putting the present invention into effect, FIG. 4 is an illustration along line A - A of FIG. 2 showing the operation of a modern pulp treating means in accordance with the invention, and FIG. 5 is a detailed illustration of a third preferred embodiment of a screen/filter structure in accordance with the present invention.

First of all, all kinds of pulp treating means, i.e., screening or dewatering devices in accordance with the present invention are proposed to divide the pulp into two fractions; a first fraction being able to penetrate the perforated surface, and called either accept or filtrate depending on the use of the pulp treating means, and a second fraction remaining on the side of the pulp to be treated and called either reject or thickened pulp, respectively.

In accordance with FIG. 1, the pulp treating means comprises an outer housing 1, an inlet conduit 2 for the pulp, a discharge conduit 3 for a second fraction, a discharge conduit 4 for a first fraction, a conduit 5 for compressed air or equivalent, and a perforated surface 6, i.e., a screen or a filter drum, inside the housing and a rotor 7 with a shaft 8 and drive equipment. Preferably the rotor 7 is disposed inside the perforated surface 6 so as to dispose the rotor blades 9 or equivalent close to the surface of the perforated surface 6. The rotor blades 9 are preferably similar in shape to the blades of screening apparatuses, whereby the front edges of the rotor blades develop a slight pressure pulse towards the screen drum and the rear edges of the blades develop a slight pressure pulse directed from the screen drum towards the rotor.

The purpose of the rotor has, however, been enhanced from that of creating pressure fluctuations in the neighborhood of the perforated surface.

Deviating from conventional arrangements, there is a space 10 on the side of the perforated surface facing the first fraction between the perforated surface 6 and the housing, which space is separate from the rest of the pulp treating apparatus, said space being provided with protruding conduits 4 and 5 for the first fraction and for compressed air respectively. The inlet conduit for compressed air or for corresponding gas is preferably provided with a pressure valve 11 for regulating the pressure prevailing in the space 10 if desired.

Principally, the method of the invention functions (as shown in FIG. 2) so that there has been arranged in the space 10 or a so-called secondary side, by means of a valve, such a pressure p1 that the centrifugal force of both the pulp and the suspension, and the inner pressure, i.e. the pressure p2 of the so-called primary side against the screen surface prevent the gas from discharging itself to the opposite side of the screen/filter surface, but during the underpressurized stage (pressure p3), which is caused by the rotor blade, the gas discharges itself from the area of the rear edge of the blade through the scree/filter surface, thus securing that the openings of the screen/filter surface certainly become clear. Hence, $p1<p2$ but $p1>p3$. After the effect of the rotor blade has stopped, the centrifugal force and the pressure prevailing inside the perforated surface together overcome the gas pressure and the fiber suspension/liquid is filtered through the perforated surface conventionally, whereby the gas seeks its way to the center of the rotor. The gas is collected in the center of the rotor due to its lower specific gravity whereby the centrifugal force acting on the pulp throws pulp more violently outwards and the gas is forced in the middle of the rotor. Thus, every single blade with its sloping rear face causes a back-blow through the screen/filter surface, which blow clears the openings of the screen/filter surface. In other words, during one revolution of the rotor the screen/filter surface is blown clear as many times as the rotor has blades or equivalent. Considering that the rotor surface may be grooved in a manner corresponding to modern screen surfaces, it can be noticed that the number of clearing times per each revolution of the rotor may be even several dozens.

In FIG. 3 there is shown an embodiment designed especially for putting the present invention into effect. Its structure is quite the same as the one of the pulp treating means illustrated in FIG. 1. The only remarkable exception is the direction of the axis 20 of the means, as it is substantially horizontal in the case of this embodiment. The pulp treating means comprises a substantially cylindrical housing 21, a preferably fixed substantially cylindrical perforated surface 22 therein, a rotatably arranged rotor 23 within the surface 22 and a number of conduits arranged through its wall. Conduit 24 is for introducing the pulp to be treated into the means and more closely inside said surface 22 in the same space with the rotor. Conduit 25 is for the discharge of the first fraction from the pulp treating means from the space between the screen/filter surface 22 and the housing 21. Conduit 26 is for discharging the second fraction from inside the screen/filter 22. Conduit 27 is for feeding the washing medium between the perforated surface 22 and the housing 21.

FIG. 4 shows a section along line A—A of FIG. 3. As shown in FIG. 4 the discharge conduit 25 for the first fraction is provided with a level sensing means 28 for adjusting the discharge valve 29 or a discharge pump. Above that level the apparatus outside the perforated surface is mostly filled with air as the apparatus is partially open to atmosphere, i.e., not entirely filled with pulp, not pressurized. The inside of the perforated surface is filled with a rotating annulus 30 of pulp, the rotation of which is caused by the rotating rotor 23, and an air "bubble" 31 in the center of the pulp treating means.

As shown in the Figures, the first fraction is forced through the perforated surface along the entire perimeter of the drum mostly due to the centrifugal force pressing the rotating pulp annulus 30 against the perforated surface.

Naturally, it is possible that the rotating component of the pulp treating means is the perforated surface itself as shown in FIG. 5, whereby the stationary blades 41 or equivalent create the necessary pressure difference over the perforated surface 42. The stationary blades 41 have been attached to the housing of the pulp treating means or to another appropriate location. As the washing medium, i.e., gas, is introduced to the outer side of the perforated screen/filter surface and as the pulp rotates with the perforated surface there are two opposite forces their magnitude being normally such that the sum of the force originating from the feed pressure and the centrifugal force is stronger. However, the stationary blades are arranged in such a way that as the perforated surface rotates the blades create high pressure zone between themselves and the perforated surface assisting the medium to penetrate the perforated surface and thus, to wash the perforations. Thus, the sum of the pressure of the medium and the pressure created by the stationary blade is stronger than the centrifugal force and the force due to feed pressure of the pulp. It is also possible that the gas or other equivalent fluid is fed from a stationary, pressurized space disposed close to the blades on the opposite side of the screen/filter surface.

At this stage, it is worth mentioning that the gas mixed with the pulp and introduced through the screen/filter surface need not cause any big problems because it can be discharged, for example, with a centrifugal pump provided with an air separation system, which pump is needed anyway for conveying the pulp. On the other hand, it must be noticed that in a non-pressurized system the gas mostly discharges by itself from the pulp in an apparatus following the screen/-thickener.

As can be seen from the above description, a completely new and simple method has been developed to highly efficiently keep the screen/filter surfaces clear by preventing the accumulation of a fiber mat onto the screen/filter surfaces. As it appears from the above, the method according to the present invention is well applicable to a wide variety of pulp treating equipment. By increasing the pressure of the secondary side, a back-flow can be effected in the whole area of the screen/filter drum, by means of which back-flow the screen/filter surface can be easily cleared at the same time if, for example, said surface has for some reason become clogged. In principle, the invention is applicable to all places where clogging of a perforated surface constitutes a problem and where compressed air or equivalent gas can be considered to be a means of clearing thereof. In some cases, the use of fluid for rinsing the screen/filter surfaces is also worth its while. Hence, what has been described above, is in no way intended to limit the invention, but it discloses only a few especially preferable embodiments of the invention, the protective scope of which is defined in the accompanying claims only.

We claim:

1. A method for keeping a perforated surface of a pulp treating means clean during treatment of pulp, in which method pulp is divided into two fractions including a first fraction penetrating the perforated surface and a second fraction remaining on the side of the pulp to be treated, the pulp treating means including a housing, the perforated surface being arranged within the housing, and means for creating local pressure fluctuations, the pressure fluctuation creating means being arranged close to the perforated surface, the housing being provided with a conduit for introducing the pulp to be treated into the pulp treating means, two additional conduits for discharging the first and second fractions of pulp after the treatment respectively, and a further conduit for introducing to the side of the perforated surface facing the first fraction, a medium having a specific weight lower than that of the pulp, the method comprising the steps of:

feeding the pulp into the pulp treating means at a pressurized state;

rotating the pulp by rotating the means for creating local pressure fluctuations;

passing a first fraction of the pulp through the perforated surface by means of a combined effect of the feed pressure and a centrifugal force caused by the rotation of the pulp;

creating a low pressure zone between the rotating means for creating local pressure fluctuations and the perforated surface;

introducing a medium having a specific gravity lower than that of the pulp to be treated to a side of the perforated surface facing the first fraction;

bringing the medium into communication with the perforated surface;

making the medium flow through the perforated surface due to the fact that the pressure of the medium is higher than the pressure being formed in the low pressure zone, so that the medium back-flushes the perforated surface; and collecting the medium into a center area of the pulp treating means.

2. The method as defined in claim 1, including discharging the medium from the pulp treating means with the second fraction of pulp.

3. A method for keeping a perforated surface of a pulp treating means clean during treatment of pulp, in which method pulp is divided into two fractions including a first fraction penetrating the perforated surface and a second fraction remaining on the side of the pulp to be treated, the pulp treating means including a housing, the perforated surface being arranged within the housing, and means for creating local pressure fluctuations, the pressure fluctuation creating means being arranged close to the perforated surface, the housing being provided with a conduit for introducing the pulp to be treated into the pulp treating means, two additional conduits for discharging the first and second fractions of pulp after the treatment, respectively, and a further conduit for introducing to the side of the perforated surface facing the first fraction, a medium having a specific weight lower than that of the pulp, the method comprising the steps of:

feeding the pulp into the pulp treating means at a pressurized state and rotating the pulp by rotating the perforated surface;

passing a first fraction of the pulp through the perforated surface by means of a combined affect of the feed pressure and a pressure formed by centrifugal force caused by rotation of the pulp;

creating a high pressure zone between the rotating perforated surface and the means for creating local pressure fluctuations;

introducing a medium having a specific gravity lower than that of the pulp to be treated, to a side of the perforated surface facing the first fraction;

bringing the medium into communication with the perforated surface;

making the medium flow through the perforated surface due to the fact that the pressure medium in the high pressure zone is higher than the combined effect of the feed pressure and the pressure generated by the centrifugal force, so that the medium backflushes the perforated surface; and collecting the medium into a center portion of the pulp treating means.

4. A method as defined in claim 3, including discharging the medium from the pulp treating means with the second fraction of pulp.

* * * * *